US006733404B2

(12) United States Patent
Fritzke et al.

(10) Patent No.: US 6,733,404 B2
(45) Date of Patent: May 11, 2004

(54) INSERT FOR A BAT HAVING AN IMPROVED SEAM ORIENTATION

(75) Inventors: Mark A. Fritzke, Portland, OR (US); Michael D. Eggiman, North Plains, OR (US); William Jerome Garnett, Beaverton, OR (US)

(73) Assignee: Wilson Sporting Goods Co., Chicago, IL (US)

( * ) Notice: Subject to any disclaimer, the term of this patent is extended or adjusted under 35 U.S.C. 154(b) by 24 days.

(21) Appl. No.: 10/033,805

(22) Filed: Dec. 28, 2001

(65) Prior Publication Data

US 2002/0091022 A1 Jul. 11, 2002

Related U.S. Application Data

(63) Continuation-in-part of application No. 09/396,700, filed on Sep. 15, 1999, now Pat. No. 6,497,631.

(51) Int. Cl.[7] ..... A63B 59/06
(52) U.S. Cl. ..... 473/566; 473/567
(58) Field of Search ..... 473/564–568, 473/457, 514, 520

(56) References Cited

U.S. PATENT DOCUMENTS

| | | | | | |
|---|---|---|---|---|---|
| 2,379,006 | A | * | 6/1945 | Johnson | 473/568 |
| 3,876,204 | A | * | 4/1975 | Moore et al. | 473/520 |
| 3,963,239 | A | * | 6/1976 | Fujii | 473/519 |
| 4,931,247 | A | * | 6/1990 | Yeh | 264/258 |
| 5,676,610 | A | * | 10/1997 | Bhatt et al. | 473/566 |
| 5,899,823 | A | * | 5/1999 | Eggiman | 473/566 |
| 6,152,840 | A | * | 11/2000 | Baum | 473/564 |
| 6,176,795 | B1 | * | 1/2001 | Schullstrom | 473/566 |

* cited by examiner

*Primary Examiner*—Mark S. Graham
(74) *Attorney, Agent, or Firm*—Terence P. O'Brien

(57) ABSTRACT

A bat includes a substantially tubular frame, a substantially tubular body and at least one sheet. The frame extends along a longitudinal axis. The frame has a handle portion and a primary hitting portion. The body is coaxially aligned with the hitting portion of the frame. The sheet has a proximal edge, a distal edge, and first and second side edges. The sheet is coupled to at least a portion of one of the hitting portion of the frame and the body such that the first and second edges each extend from the proximal edge to the distal edge along a path that is substantially non-parallel with the longitudinal axis.

21 Claims, 9 Drawing Sheets

INSERT FOR A BAT HAVING AN IMPROVED SEAM ORIENTATION

RELATED U.S. APPLICATION DATA

The present invention is a continuation-in-part of U.S. patent application Ser. No. 09/396,700, entitled "Ball Bat", filed on Sep. 15, 1999 by Fritzke et al., Pat. No. 6,497,631.

FIELD OF THE INVENTION

The present invention relates generally to baseball and softball bats. In particular, the present invention relates to an insert for a ball bat, which is formed at least in part from at least one layer of composite material having an improved seam orientation.

BACKGROUND OF THE INVENTION

Recent years have seen an emergence of new and improved tubular metallic softball and baseball bats. The most common tubular bat is the aluminum single-wall tubular bat. Such bats have the advantage of a generally good impact response, meaning that the bat effectively transfers power to a batted ball. This effective power transfer results in ball players achieving good "slugging" distances with batted balls. An additional advantage of such aluminum bats is the improved durability over crack-prone wooden bats.

Despite the advantages of tubular aluminum bats, there is an ongoing effort to improve the performance and durability of the conventional design. Generally speaking, bat performance is a function of the weight of the bat, the size of the hitting area or "sweet spot" of the bat, and the impact response of the bat. The durability of a bat relates, at least in part, to its ability to resist denting and depends on the strength and stiffness of the tubular frame. While recent innovations in bat technology have increased performance and durability, most new bat designs typically improve performance or durability at the expense of the other because of competing design factors. For example, an attempt to increase the durability of the bat often produces an adverse effect on the bat's performance.

More specifically, the impact response of a bat depends on the bat wall's elasticity, rebound recovery time, and rebounding force. Generally, impact response is optimized when the bat undergoes maximum elastic deflection and then rebounds with the greatest force in the shortest amount of time. The elasticity of a bat can be increased by reducing the thickness of the bat's tubular frame. In contrast, the durability of a bat generally is improved by increasing the thickness of the tubular frame. Consequently, a bat having a relatively thin tubular wall is capable of large elastic deflection, but may be vulnerable to undesirable local plastic deformation (or "denting"). On the other hand, a relatively thick tubular wall is more durable but may be too stiff to achieve optimum slugging performance. Thus, enhancing one design aspect of a bat often compromises another.

Another example of competing design factors concerns the bat's optimum hitting area or "sweet spot." The sweet spot is typically located near the center of the impact area of the bat. The performance of the bat drops off considerably when a ball impacts the bat outside the sweet spot, for example, near the end of the bat. When this occurs, the batter feels greater vibrations and transfers less energy from the bat to the ball. An obvious way to increase the sweet spot of a bat is to increase the length and circumference of the bat. This option is constrained by institutional rules and regulations. In addition, an increase in the overall size of the bat undesirably adds weight, often causing reduced bat speed and less slugging distance. (A hitter often can increase bat speed by using a lighter bat, thereby increasing the force transferred to the ball upon impact.

An example of a bat incorporating a composite insert is shown in U.S. Pat. No. 5,364,095. This patent discloses a tubular aluminum bat having a carbon composite insert to increase the "stiffness" of the metal tube. The insert is made of multiple fiber layers, each layer having bi-directional woven fibers directed at 0 and 90 degrees relative to the axis of the bat. The insert is bonded to the barrel portion of the surrounding metal tube or frame and presses outwardly on the frame to produce a pre-load stress of several thousand pounds per square inch. The insert appears to be formed from multiple layers of glass and carbon fiber material (thickness of 0.03 to 0.05 inch) so as to be a self-supporting structure capable of withstanding several thousand pounds of compressive stress. This design gives the bat a relatively stiff, rigid tubular frame which appears to be capable of limited elastic deformation, a less than ideal trait if the goal is to optimize slugging performance. (One would expect this design to behave like a single-wall bat in which the compressive stress must be overcome before the wall begins to deflect.)

While composite materials offer the advantage of a high strength to weight ratio, such materials also present design challenges. Composite inserts and bat frames are prone to wear and tear due to the inter-laminar shear which can occur between bonded layers of composite material. The deflection caused when a ball impacts the bat produces shearing stresses between the composite layers, sometimes causing the bond between adjacent layers to fracture or separate (especially over time).

Additionally, the composite materials are typically formed as sheets, which are wrapped into a generally cylindrical shape. These sheets typically have seams formed where two wrapped edges of the sheet meet. The seam typically extends the length of the sheet in a position that is substantially parallel with the longitudinal axis of the insert or the bat frame. Multilayered composite inserts utilize two or more sheets, each having a separate seam. Often the longitudinally extending seams of two or more sheets will generally overlap each other. These longitudinally extending seams can be subjected to large impact loads, particularly when the seam or seams align with the line of action of contact between the ball and the bat, commonly referred to as the "line of action" of the bat. The line of action of the bat also refers to the longitudinal portion of the bat, which upon impact with a ball, receives an impact load and transmits the load longitudinally to the handle of the bat. It is not uncommon for bats having a composite layer and a longitudinally extending seam to crack, separate, or otherwise fail at a point along the seam. Further, a bat including at least one composite layer having a longitudinally extending seam, can have inconsistent or varied performance characteristics depending upon the orientation of the bat, and in particular the location of the seam of the composite layer, in relation to the location of impact with the ball. The slugging performance of such a bat when impacted by a ball along the composite layer's longitudinal seam will be lower than when a ball contacts the bat at a location away from the longitudinal seam.

Thus, despite the advantages offered by composite materials, there are a number of drawbacks associated with using such materials including the potential for reduced elastic deflection, a tendency of the composite layers to separate over time due to inter-laminar shear, the susceptibility of the composite insert to fail along the longitudinal seam of the insert, and inconsistent slugging performance resulting from a longitudinal seam of a composite layer of a bat.

As a result, there is a need for a tubular bat that offers at least some of the advantages of composite materials without the constraints. There is a need for a tubular bat that provides excellent slugging performance and improved durability. There also is a need for a multi-wall bat which has a relatively thin barrel wall and yet exhibits excellent durability. Further, there is a need for a single wall bat having the excellent durability characteristic of most single wall bats as well as improved slugging performance. It would be advantageous to provide a bat including an insert having at least one composite layer with an improved seam orientation that is less susceptible to failure and therefore provides improved reliability. What is needed is a bat having an insert with at least one layer of composite material that provides the bat with consistent slugging performance.

SUMMARY OF THE INVENTION

The present invention provides an improved baseball or softball bat with superior durability characteristics and little or no reduction in bat performance. The invention does so by providing a relatively thin, light (but strong) composite material, with directional strength characteristics to resist dent-causing forces, in bonded relationship to a metal carrier. For example, the present invention includes a single- or multi-wall tubular bat having at least one composite layer, with its greatest strength in a substantially circumferential direction, bonded directly to a tubular member which deflects upon ball impact.

According to a principal aspect of the invention, a bat includes a tubular frame and a tubular insert reinforced with at least one composite layer. The composite layer has its greatest strength in a substantially circumferential direction and is bonded to at least a portion of the outer surface of the insert. The composite layer provides several advantages, including improved durability with little or no reduction in performance. Because the composite layer adds strength and stiffness to the insert in the circumferential direction, it helps prevent local plastic deformation caused by circumferential stresses while allowing the frame and insert to deflect sufficiently in the axial direction to transfer substantial energy back to the ball as it leaves the surface of the bat. In another embodiment, the composite layer(s) is bonded to at least a portion of the inner surface of the insert.

The present invention also contemplates the use of multiple composite layers of varying lengths and different strength characteristics bonded to the impact portion and/or the insert of a bat so that a manufacturer can add strength and stiffness to a bat where it is needed and in the direction that it is needed. Because the intended use of a bat often drives its design, the various attributes of the composite layers, such as length, thickness, location on a bat, or orientation of fibers, may be selected to suit a particular application.

Another embodiment, which exhibits excellent durability and performance characteristics for hitting a softball, has two composite layers bonded to the outer surface of a tubular sleeve. A longer, first composite layer having its fibers oriented substantially at 0 degrees relative to the axis of the bat is applied directly to the outer surface of the sleeve. A shorter, second composite layer having its fibers oriented substantially at 90 degrees relative to the axis of the bat is placed on top of the first layer, with the second layer being positioned closer to the "sweet spot."

According to another preferred aspect of the invention an insert for a bat includes a substantially tubular body and at least one sheet. The tubular body extends along a longitudinal axis. The body has internal and external surfaces. The sheet has a proximal edge, a distal edge, and first and second side edges. The sheet is coupled to at least a portion of one of the internal and external surfaces of the body such that the first and second edges each extend from the proximal edge to the distal edge along a path that is substantially non-parallel with the longitudinal axis.

According to another preferred aspect of the invention a ball bat includes a substantially tubular frame, a substantially tubular body and at least one sheet. The frame extends along a longitudinal axis. The frame has a handle portion and a primary hitting portion. The body is coaxially aligned with the hitting portion of the frame. The sheet has a proximal edge, a distal edge, and first and second side edges. The sheet is coupled to at least a portion of one of the hitting portion of the frame and the body such that the first and second edges each extend from the proximal edge to the distal edge along a path that is substantially non-parallel with the longitudinal axis.

According to another preferred aspect of the invention a substantially tubular insert for a bat extends along a longitudinal axis. The insert includes a plurality of layers. Each layer forms at least part of a tubular shape and connects to at least one of the other layers. Each layer has a proximal edge, a distal edge, and first and second side edges. The first and second edges of each layer extend from the proximal edge to the distal edge along a path that is substantially non-parallel with the longitudinal axis.

According to another preferred aspect of the invention, a method of manufacturing a composite insert for a ball bat includes the steps of obtaining an elongate, generally cylindrical mandrel having a periphery and extending along a longitudinal axis, and forming at least first and second layers of composite material into a predetermined shape. Each layer has a proximal edge, a distal edge, and first and second side edges. The method also includes wrapping the first layer about at least a portion of the periphery of the mandrel such that the first and second edges of the first layer each extend from the proximal edge to the distal edge along a path that is substantially non-parallel with the longitudinal axis, and wrapping the second layer about at least a portion of the first layer such that the first and second edges of the second layer each extend from the proximal edge to the distal edge along a path that is substantially non-parallel with the longitudinal axis. The method further includes removing the mandrel from the at least first and second layers.

Various advantages and features of novelty which characterize the invention are particularized in the claims forming a part hereof. However, for a better understanding of the invention and its advantages, reference should be had to the drawings and to the accompanying description in which there is illustrated and described preferred embodiments of the invention.

DETAILED DESCRIPTION OF THE PREFERRED EMBODIMENTS

Figure 1:
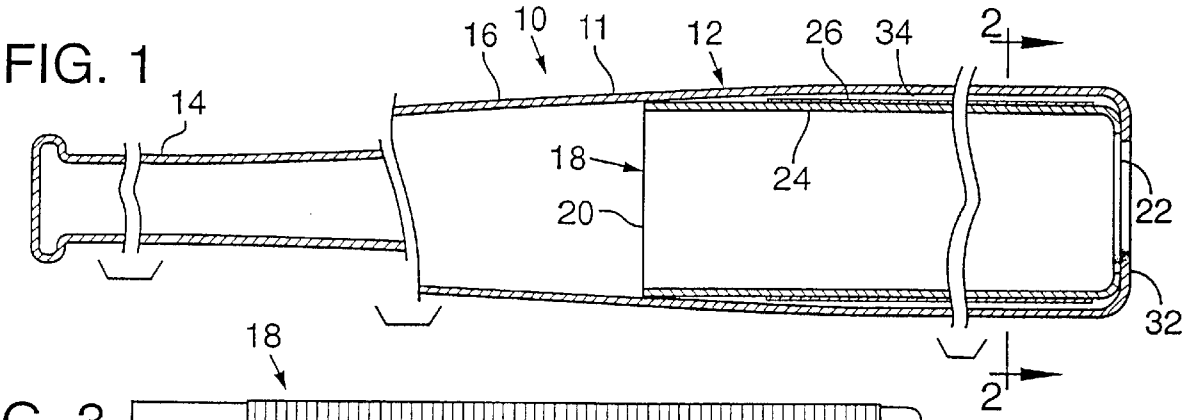
FIG. 1 is a sectional view of a bat in accordance with the present invention, which includes an insert and a composite layer on the outer surface of the insert.

Referring to FIG. 1, a tubular bat 10, according to one embodiment of the present invention, has a tubular frame 11 with a relatively large constant-diameter impact portion 12, a relatively small diameter handle portion 14, and an intermediate tapered portion 16 that extends between the handle and impact portions. The impact portion 12 is "tubular" or "substantially tubular," terms intended to encompass softball style bats having a substantially cylindrical impact portion (or "barrel") as well as baseball style bats having a substantially conical (or "frustum-like") barrel.

The tubular frame 11 engages a tubular insert 18 within the impact portion 12. The bat 10 provides two essentially parallel walls in the "hitting zone" or barrel region. The insert 18 is restrained within the tubular frame 11 either by retaining the ends of the insert in place or at least trapping the insert within the barrel to permit some axial movement. As shown in FIG. 1, for example, a first end 20 of the insert 18 contacts the intermediate tapering portion 16 of the tubular frame 11, and a second end 22 of the insert 18 contacts an end portion 32 of the tubular frame 11. However, it will be appreciated that the ends of the insert can be supported or fixedly coupled to the frame in other ways. For example, the second end 22 of the insert 18 can be held in place by an end plug (not shown) which forms a closure for the tubular frame 11 at the end portion 32. Alternatively, the insert 18 may be end-supported within the tubular frame 11 in other ways, such as by fasteners or an adhesive. The insert 18 also may be compressively restrained at its ends by the impact portion 12. While it may be somewhat advantageous to substantially pin or lock the insert ends in place to limit axial movement relative to the impact portion, the present invention also provides benefits even if the insert is not locked in place and is free to move axially to some extent relative to the impact portion.

A gap 34 preferably exists between the impact portion 12 and the insert 18. The gap 34 allows the impact portion 12 to undergo some elastic deflection before contacting the insert 18. The size of the gap 34 will vary depending on the size and type of bat. In some applications, the gap is very small or nonexistent (i.e., zero clearance). The spatial relationship between the insert and impact portion 12 only needs to be sufficient to allow the insert and impact portion to move substantially independent of one another upon impact. This independent movement allows the insert to act much like a leaf spring upon impact. The presence of grease or other lubricant in the gap or, if there is no gap, at the interface between the insert and impact portion, facilitates such independent movement. In applications where a larger gap 34 is present, it is often advantageous for the impact portion 12 of the tubular frame 11 to be more elastic so that the frame will deflect across the gap 34 to transfer a sufficient portion of the impact load to the insert 18.

In those applications where a gap is provided between the insert and impact portion, the gap may be filled with a urethane, rubber or other elastic filler material. Even if the filler material is glued to the insert and impact portion, the pliable nature of the filler material still would permit significant relative independent movement between the insert and impact portion in the axial direction (again, much like a leaf spring). (This relationship is to be contrasted with the dynamics of these components in the radial direction, which is interdependent due to the load transfer dynamics between the insert and impact portion.)

The foregoing construction and relationship between the impact portion and insert is discussed in part in U.S. Pat. No. 5,415,398, the disclosure of which is incorporated by reference. In sum, the present invention works best in a multi-wall context when the insert wall is free to move substantially independent of the impact portion 12 in the axial direction and is not bonded or otherwise fixedly coupled to the impact portion by friction fit, adhesion or otherwise. In other words, the impact portion and insert do not behave like an integrated single-wall structure.

It will be apparent from the foregoing discussion that the principles of the present invention also apply if the insert is mounted in overlying coaxial relationship with the barrel, in which case the insert (or more accurately "exert") assumes the role of the "impact portion" to engage the ball and the impact portion assumes the role of the "insert."

Figure 2:
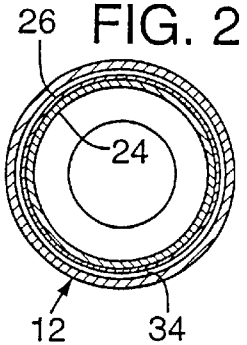
FIG. 2 is a sectional view taken along line 2—2 of FIG. 1.

Referring now to FIG. 2, the insert 18 comprises a metallic tubular sleeve 24 and a relatively thin composite layer 26 having its greatest strength in a substantially circumferential direction. The composite layer is bonded to the outer surface of the tubular sleeve 24. Preferably, the tubular sleeve 24 is made of the same material as the tubular frame 11. However, it is not critical to use the same materials for both components. A popular material for the bat and the sleeve is high-grade aluminum such as C405 or C555. It should be understood that other materials will suffice. For instance, at a higher cost, titanium or metal matrix composites (such as aluminum matrix composites) can be used for the tubular frame 11 and tubular sleeve 24.

The tubular sleeve 24, is essentially isotropic with respect to its ability to withstand applied stresses. In other words, the strength of tubular sleeve 24 is essentially equal in the circumferential and axial directions. When a bat strikes a ball, most of the stress created by the impact is distributed in the circumferential direction (sometimes referred to as hoop stress). It is believed that localized dents or dimples in the impact portion's outer surface, which have a deleterious effect on durability, are due to the circumferential stress component of forces generated by the ball's impact with the bat. Therefore, a composite layer 26 having its greatest strength in a substantially circumferential direction provides strength and stiffness to the tubular sleeve 24 in the direction that it is most needed to resist denting.

The composite layer 26 includes structural material to provide structural stability, and matrix material to support the structural material. In a preferred embodiment, the structural material is a series of fibers that are supported within the matrix material. In order for the composite layer 26 to have its greatest strength in a substantially circumferential direction, the fibers must extend in a direction greater than 45 degrees, that is, at an angle closer to 90 degrees than 0 degrees, in the circumferential direction. Most preferably, the fibers are oriented substantially at a ninety degree angle relative to the longitudinal center axis of the tubular frame 11. For example, the fibers may be oriented at about 65 to 90 degrees relative to the axis of the tubular frame. The composite layer 26 preferably has a thickness of within the range of about 0.003 to 0.015 inch (about 0.0055 inch for example, at least for some applications). More important than the thickness of any particular composite layer is the thickness of the composite material overall, which preferably falls within a range less than about 0.015 inch, most preferably about 0.003 to 0.015 inch. For example, a desirable thickness of say 0.006 inch can be achieved by a single layer of composite material having a thickness of 0.006 inch or two layers having a thickness of 0.003 inch each.

The composite layer 26 preferably consists of structural materials that are strong, stiff, and durable. In a preferred embodiment, the composite layer 26 includes carbon fibers commercially available in carbon fiber composite sheets. However, the fibers could be some other type of fiber material such as, for example, carbon, metal, Kevlar™, or fiberglass.

The matrix of the composite layer 26 preferably is sufficiently durable and has sufficient adhesion properties to continue supporting the structural material even after repeated impacts. In a preferred embodiment, the matrix material is a toughened epoxy. Alternatively, the matrix can be some other thermally setting resin, such as a polyester or vinyl ester, or a thermoplastic resin. In an alternative preferred embodiment, the layer 26 can be made of other materials such as, for example, a rubber, a urethane, an elastomer, or combinations thereof.

An exemplary construction of the bat has the tubular frame 11 swaged from a constant-diameter aluminum tube to yield an integral, weld-free frame. Such swaging results in a tubular frame with thinner walls at the impact portion 12 and thicker walls at the handle portion 14. While swaging is used to produce the tubular frame 11 of the illustrated embodiment, it should be understood that other conventional methods of manufacturing the tubular frame may be used.

The sleeve 24 preferably is heat treated (in a manner conventional for aluminum alloys) and treated to apply a yellow chromate surface coating, using for example military specification MIL-C-5541. The coating provides the sleeve with a prepared surface which facilitates adhesion of the composite layer 26. A sheet of preimpregnated composite material ("prepreg") is then wrapped around the outer surface of the sleeve. To avoid an open seam between the two edges of the composite layer, the composite layer is wrapped around the sleeve such that the trailing edge of the composite layer slightly overlaps the leading edge. During the heat curing of the prepreg composite, the material bonds to the tube.

As one illustrated example, the tubular frame 11 has a yield strength of about 85,000 psi and the impact portion 12 is about 13 inches long with a wall thickness of 0.050 inch. The tubular sleeve 24 is about 13.25 inches long with a wall thickness of 0.054 inch. The composite layer 26 is about 8.5 inches long and about 0.055 inch thick, with the fibers oriented at substantially 90 degrees to the longitudinal axis. The composite layer is positioned on the tubular sleeve such that a first end 28 of the composite layer is 4.00 inches from the first end 20 of the insert 18 and a second end 30 of the composite layer 26 is 0.75 inch from the second end 22 of the insert 18. The outer diameter of the insert 18 is such that a gap 34 (FIG. 1) of about 0.0045 inch exists between the outer surface of the insert and the inner surface of the impact portion 12 of the tubular frame 11.

While such dimensions yield excellent results, it is to be understood that they are exemplary only, and that many permutations of the bat frame, insert, and gap dimensions will work equally well. All permutations fall within the scope of the present invention.

The composite layer reinforces the sleeve 24, giving the insert greater hoop (circumferential) stiffness and strength in the impact portion (barrel) of the bat. The impact portion receives greater circumferential support, making it less prone to local plastic deformation (or "denting") and hence more durable. At the same time, the composite layer adds very little weight to the bat. It will be appreciated that a relatively thin composite material is preferred, typically one to three layers of composite material, since larger inter-laminar shear problems are more likely to occur as the thickness of the layered composite material increases. It also will be appreciated that the composite layer(s) can be relatively thin because they do not form a self-supporting structure; the layer(s) is (are) carried by the metal sleeve which itself is a self-supporting structure.

Figure 3:
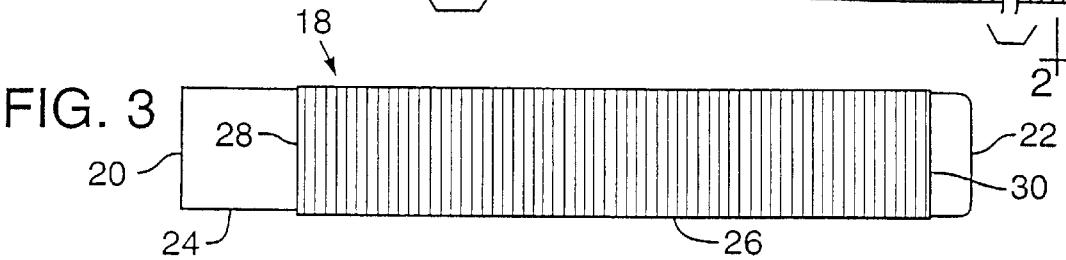
FIG. 3 is an enlarged view of the insert of FIGS. 1 and 2.
Figure 4:
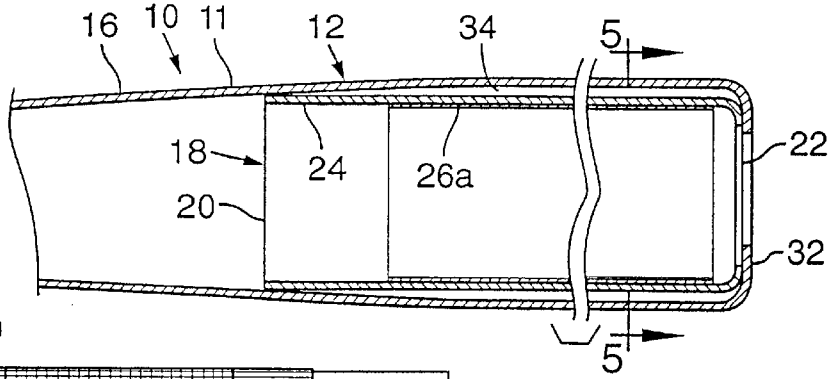
FIG. 4 is a sectional view of a second embodiment having an insert and a composite layer on the inner surface of the insert.
Figure 5:
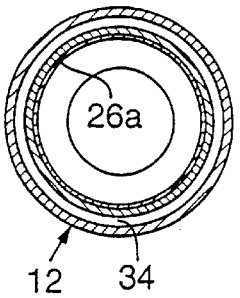
FIG. 5 is a sectional view taken along line 5—5 of FIG. 4.

In another embodiment of the present invention, as shown in FIGS. 4 and 5, a composite layer 26*a* is bonded to at least a portion of the inner surface of the insert 18 (instead of the outer surface). Although this embodiment is believed to perform as well as the embodiment of FIGS. 1–3, it is slightly less preferred from a manufacturing standpoint. It is easier and less expensive to wrap the composite layer 26 on the outer surface of the insert 18. More specifically, the composite wrap is inserted into the insert in a low tack condition. A bladder device also is inserted and inflated at low pressure (less than 1,000 psi) to assure contact between the composite and inner wall of the insert. The composite is then cured under pressure per standard composite processing methods.

Figure 6:
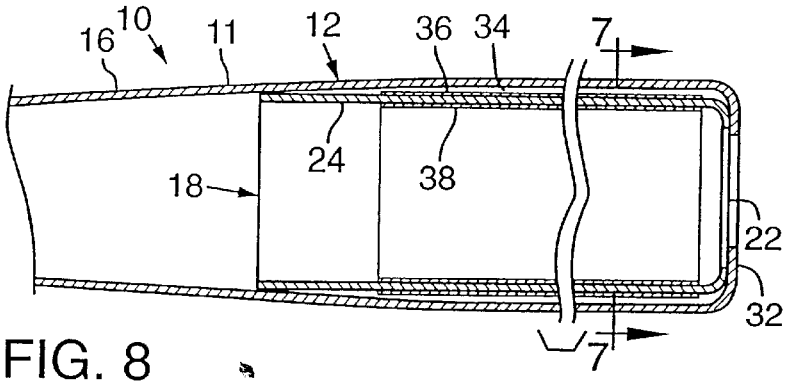
FIG. 6 is a sectional view of a third embodiment having an insert and single composite layers on both the inner and outer surfaces of the insert.
Figure 7:
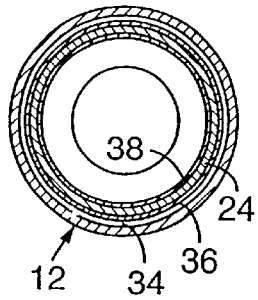
FIG. 7 is a sectional view taken along line 7—7 of FIG. 6.

In a further embodiment, as shown in FIGS. 6 and 7, a first composite layer 36 having its greatest strength in a substantially circumferential direction is bonded to the outer surface of insert 18 and a second composite layer 38 having its greatest strength in a substantially circumferential direction is bonded to the inner surface of insert 18. This embodiment provides maximum effectiveness and durability in comparison to the above-described embodiments, but with a trade off of increased manufacturing cost.

The present invention, with its insert-supported barrel and composite-reinforced insert provides several advantages. A conventional multi-wall bat having an aluminum insert exhibits excellent impact response but, due to its relatively thin outer wall, may be prone to denting and have a relatively short useful life. A conventional multi-layer composite insert supported within an aluminum tubular bat helps prevent permanent deformation and optimizes durability but may reduce desirable elastic deflection in the bat due to the high modulus of elasticity of the composite material. The present invention, however, overcomes these shortcomings by combining the elasticity and isotropic shear strength of the tubular sleeve (at the center of this load bearing member) with the circumferential strength of a thin composite material (at the outer surface of the load bearing member) to produce a bat with improved durability and little or no reduction in performance.

The present invention provides greater resistance to localized plastic deformation of the impact portion because the thin composite material gives the impact portion greater strength in the circumferential direction. Yet, the composite material does not significantly restrict elastic deflection in the longitudinal direction, allowing the insert to retain its leaf-spring capacity to transfer energy back to the ball as it leaves the surface of the bat. Moreover, because the composite material adds a significant amount of strength to the bat, thinner aluminum may be used for the tubular frame 11 and insert 18. Thus, the present invention can be made lighter than prior multi-wall aluminum bats.

Efficient use of high-cost composite material also allows for the maximization of the benefits provided by composite materials with minimal cost. Since only a thin composite material is needed (one to three layers, for example), material costs for the present invention are reduced. Furthermore, the present invention is easier and less expensive to manufacture than a self-supporting insert made entirely of composite layers. In addition, the present invention is seemingly unaffected by inter-laminar shear forces due to the fact that the composite material is located away from the neutral axis (where inter-laminar shear stresses are highest) of the insert (or other metal carrier).

Figure 8:
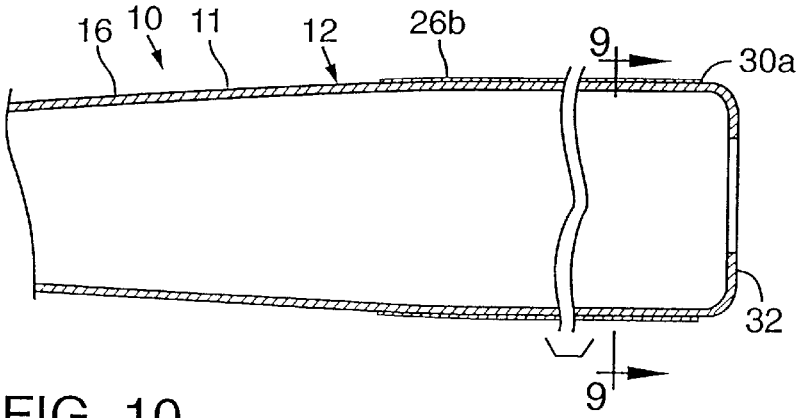
FIG. 8 is a sectional view of a fourth embodiment having a single composite layer on the outer surface of the bat's impact portion.
Figure 9:
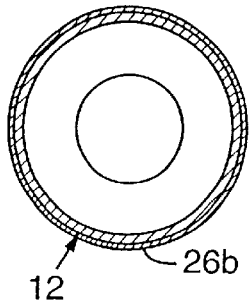
FIG. 9 is a sectional view taken along line 9—9 of FIG. 8.

While the above discussed embodiments describe the invention in the context of a multi-wall bat (with an insert/exert for example) to provide maximum "spring" to the impact portion of the bat, this invention's utility also has been demonstrated in the context of single-wall tubular bats. In one such embodiment, shown in FIGS. 8 and 9, a composite layer 26*b* having its greatest strength in a substantially circumferential direction may be bonded to at least a portion of the outer surface of the impact portion 12 of a single-wall tubular bat 10 in the manner previously described. Preferably, the composite layer 26 includes fibers oriented at about 80 to 90 degrees relative to the axis of the bat. The composite layer 26 preferably has a thickness less than about 0.015 inch, more preferably, about 0.003 to 0.015 inch, and most preferably about 0.0055 inch. A powder coating may be applied to the composite layer 26 in a conventional manner to provide a suitable surface on which graphics can be placed. This particular embodiment is a lower cost alternative to the embodiments of FIGS. 1 through 7. This embodiment not only improves the durability of conventional single-wall bats but allows the wall thickness of the impact portion to be reduced an amount sufficient to noticeably improve the impact response of a conventional single-wall bat.

In one illustrated example of this embodiment, the tubular frame has a yield strength of 85,000 psi and an impact portion that is 12 inches long and has a wall thickness of 0.067 inch. The composite layer 26*b* is about 8.5 inches long and 0.003 inch thick and is positioned on the outer surface of the impact portion 12 such that second end 30*a* is 0.75 inch from the head portion 32.

Figure 10:
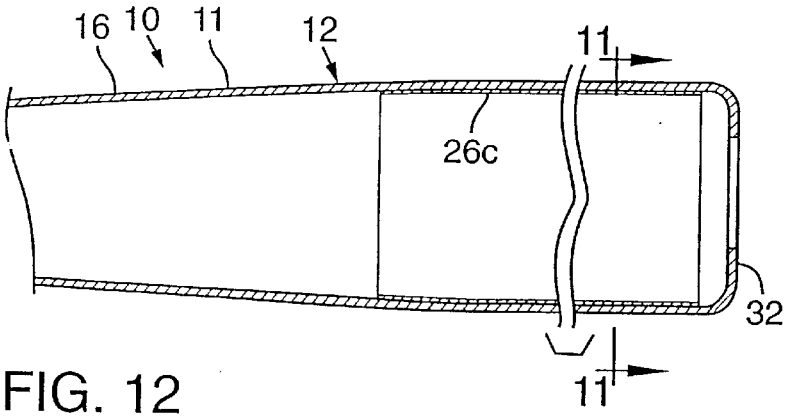
FIG. 10 is a sectional view of a fifth embodiment having a single composite layer on the inner surface of the bat's impact portion.
Figure 11:
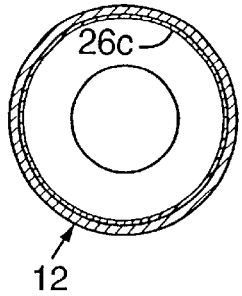
FIG. 11 is a sectional view taken along line 11—11 of FIG. 10.
Figure 12:
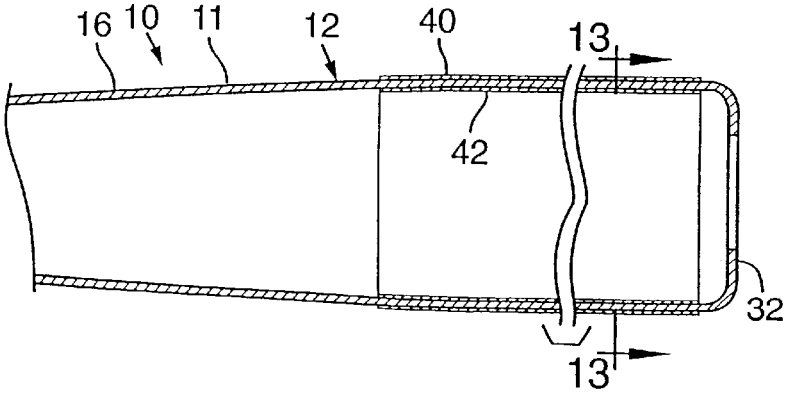
FIG. 12 is a sectional view of a sixth embodiment having single composite layers on both the inner and outer surfaces of the bat's impact portion.
Figure 13:
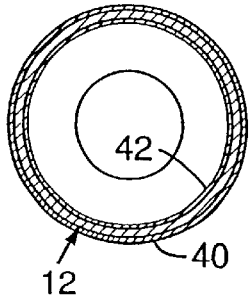
FIG. 13 is a sectional view taken along line 13—13 of FIG. 12.

Other examples of single-wall tubular bats embodying the present invention are shown in FIGS. 10–13. FIGS. 10 and 11 show a composite layer 26*c* having its greatest strength in a substantially circumferential direction bonded to the inner surface of the impact portion 12 of a tubular bat 10. Alternatively, as shown in FIGS. 12 and 13, a first composite layer 40 having its greatest strength in a substantially circumferential direction is bonded to the outer surface of the impact portion 12 and a second composite layer 42 having its greatest strength in a substantially circumferential direction is bonded to the inner surface of the impact portion 12. It will of course be appreciated that more than one layer of composite material can be bonded to the inner and/or outer surface of a single-wall bat. The preferred total thickness of the composite material on each surface, regardless of the number of layers, is less than about 0.015 inch, preferably about 0.003 to 0.015 inch and, most preferably, about 0.0055 inch (again depending on the particular application).

Though relatively thin, the composite material improves the durability of a single-wall bat. Even more remarkably, the composite material allows the bat manufacturer to reduce the wall thickness of the barrel and thereby noticeably improve the bat's impact response.

The present invention also contemplates the use of multiple composite layers banded on the impact portion and/or the insert of a bat. Banding involves the application of composite layers of varying lengths, thicknesses and fiber orientations on a surface portion of the impact portion or insert which is subject to deflection upon impact. This design exploits the directional strength of composite materials and allows the manufacturer to selectively add strength and stiffness where it is needed and in the direction that it is needed. Because the intended use of a bat often drives its design, the various attributes of the composite layers, such as length, thickness, location on a bat, or orientation of fibers, may be manipulated to suit a particular application. For example, the optimization of the composite materials in a tubular bat will vary according to different factors such as whether the bat is used for softball or baseball, whether the game involves fast pitch or slow pitch, or the experience level or style of play of a particular player. The present invention allows the manufacturer to "fine tune" the bat to give it localized strength characteristics to suit the particular application. The foregoing "banding" constructions achieve an effect much like "sidewall ironing" (a known metal working technique), but allows even greater flexibility and ease of manufacture.

Figure 14:
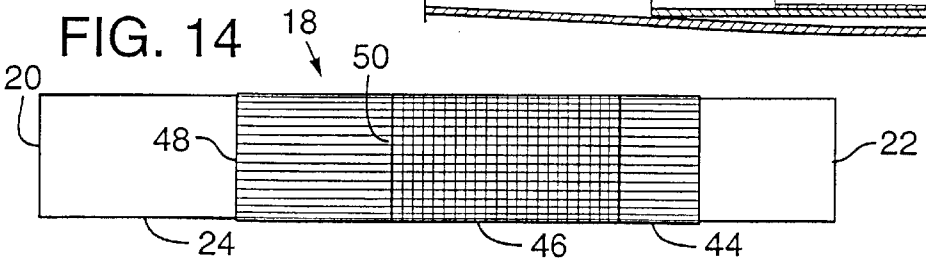
FIG. 14 is an enlarged view of an alternate insert embodiment having two composite layers bonded to an outer surface of the insert.

By way of example, a particular insert design which has been found to exhibit excellent durability and performance characteristics for hitting a softball is illustrated in FIG. 14. In this embodiment, an insert 18 for use in a tubular bat, has two composite layers. A first composite layer 44 having its fibers oriented substantially at 0 degrees relative to the axis of the bat is bonded to the tubular sleeve 24 in the mariner previously described. A shorter second composite layer 46 having its fibers oriented substantially at 90 degrees relative to the axis of the bat is bonded on top of the first composite layer 44. The first composite layer 44 covers a substantial portion of the outer surface of the tubular sleeve while the shorter, second composite layer 46, which is positioned near the center of the insert 18, covers only the portion of the insert 18 where most impacts are likely to occur. As one illustrated embodiment, the first composite layer 44 is about 8.5 inches long and about 0.003 inch thick and is positioned on the tubular sleeve 24 such that the first end 48 is about 4.00 inches from the first end 20 of the insert 18. The second composite layer 46 is preferably about 4 inches long and about 0.0055 inch thick and is positioned on the top of the first composite layer 44 such that the first end 50 of the second composite layer 46 is about 7.25 inches from the first end 20 of the insert 18.

The thickness of the insert 18 therefore is greatest near the center where there are two concentric layers of composite material and decreases (incrementally) towards the first and second ends of the insert (which are not covered by any composite material). Such an embodiment is advantageous because it provides the greatest thickness and strength in the area where most impacts occur, and less thickness and less weight (and hence greater flexibility) in the area where the stress is less. This design therefore behaves much like a tapered beam. As a result, less material is needed for the tubular sleeve 24 and impact portion12. Further, by using a shortened second composite layer 46, no more high cost composite material is used than is actually needed.

In yet another embodiment (not shown), the insert 18 of FIG. 14 may be modified so as to bond the longer composite layer (fibers at substantially 0 degree orientation) to the inner surface of the insert and bond the shorter composite layer (fibers at substantially 90 degree orientation) thereon. Alternatively, the first composite layer and the shorter second composite layer may be bonded separately to the outer and inner surfaces, respectively, of the tubular sleeve or vice versa, much like the embodiment of FIGS. 6 and 7.

As another alternative, the second composite layer can be segmented by bonding two or more spaced bands of composite material to the first composite layer or to the insert surface opposite the surface to which the first composite layer is bonded.

Figure 15:
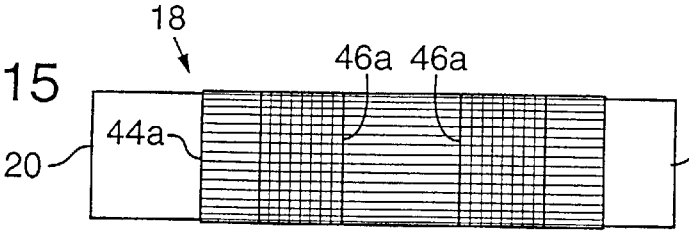
FIG. 15 is an enlarged view of another alternate insert embodiment having two composite layers, one of which is divided into separate discrete bands, bonded to an outer surface of the insert.

It will be appreciated that many of the features and principles described above can be combined to create bat designs better suited for different applications or at least to provide alternative design approaches. For example, FIG. 15 illustrates that the insert embodiment of FIG. 14 can be modified to provide a second composite layer 46*a* (overlying first layer 44*a*) having separate bands of composite material. In this way, the bat's impact portion is given additional strength and stiffness in select local locations and directions to fine tune the bat's impact response behavior. Though not shown, the second layer could be provided with three or more bands of composite material; the first and second layers could be bonded to the inner surface of the insert; and a third layer of composite material with the same or different reinforcing characteristics could be bonded to the second layer. These principles also can be applied where the insert is mounted in overlying relationship to the impact portion.

Figure 16:
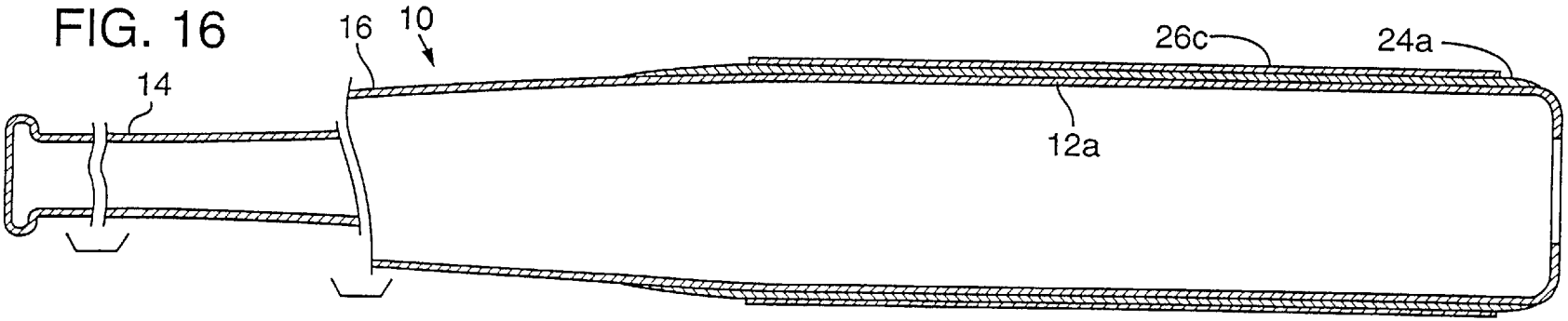
FIG. 16 is a sectional view of a seventh embodiment of the present invention.
Figure 17:
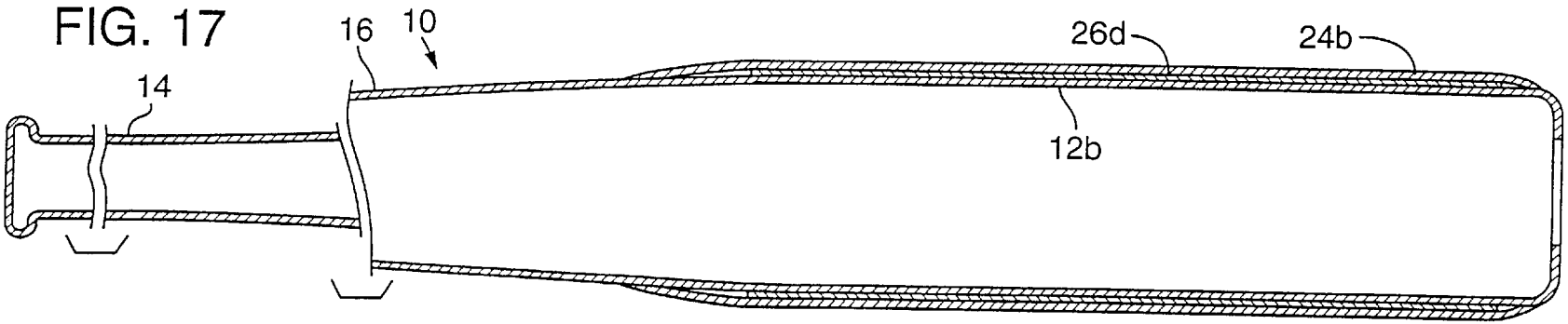
FIG. 17 is a sectional view of an eighth embodiment of the presentation.

By way of further example, FIGS. 16 and 17 illustrate the embodiment of the present invention in the context of an insert mounted in external co-axial relationship to the impact portion 12*a* (FIG. 16), 12*b* (FIG. 17). In the FIG. 16 embodiment, the insert 24*a* is mounted on the outer surface of the bat in proximate co-axial relationship with the impact portion 12*a*, and composite member 26*c* is bonded to at least a portion of the outer surface of the insert. The interface between the insert and impact portion can be defined by a gap or no gap. Again, however, the insert preferably is not bonded to the impact portion or secured by interference fit.

The FIG. 17 embodiment is similar to the FIG. 16 embodiment except that the composite member 26*d* is bonded to either the inner surface of the insert 24*b* or outer surface of the impact portion 12*b*.

Figure 18:
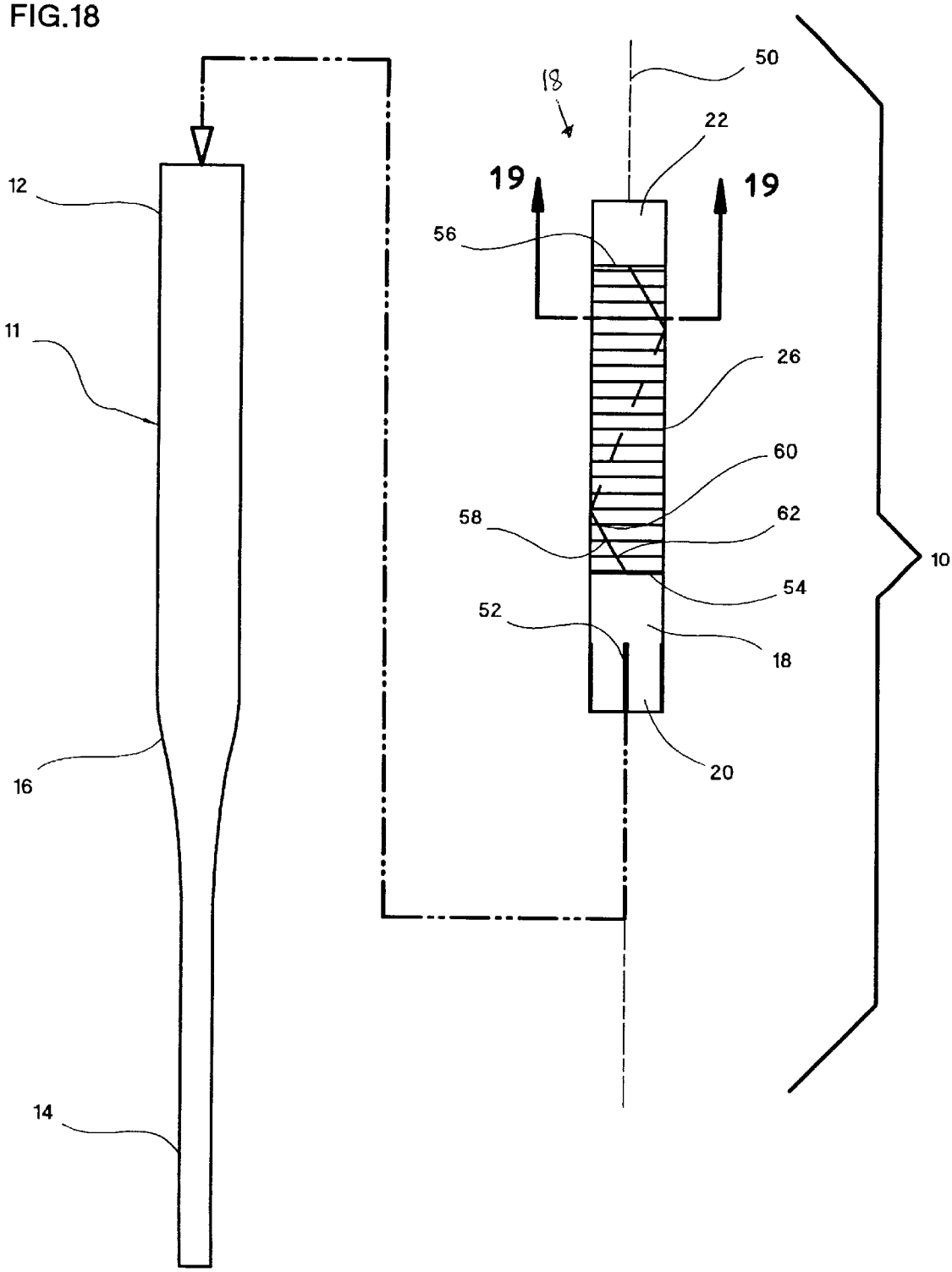
FIG. 18 is an exploded side view of a bat frame and an insert in accordance with another preferred embodiment of the present invention.

Referring to FIG. 18, in another preferred embodiment, the insert 18 extends along a longitudinal axis 50, and includes at least one slit 52 and the composite layer 26. The slits 52 extend longitudinally from the first end 20 in the direction of the second end. The slits 52 enable the first end 20 to readily inwardly deflect as it contacts the intermediate tapering portion 16 of the bat 10. The slits 52 also facilitate engagement of the first end 20 with the bat 10. In a particularly preferred embodiment, the insert 18 includes four spaced-apart slits 52. Each slit 52 has a length of approximately 1.0 inch and a width of approximately 0.0625 inches. Slits 52 having alternative dimensions and orientations are also contemplated.

The composite layer 26 is a sheet that includes a proximal edge 54, a distal edge 56, and first and second side edges 58 and 60. The first and second side edges 58 and 60 each extend from the proximal edge 54 to the distal edge 56. The layer 26 is preferably cut into a shape which, when wrapped about the insert 18, orients the first and second edges 58 and 60 along the insert 18 in a path that is substantially non-parallel to the longitudinal axis 50. The first and second edges 58 and 60 therefore cross or intersect the longitudinally extending line of action of the insert 18. In a particularly preferred embodiment, the layer 26 is cut into the general shape of a parallelogram and wrapped around the insert 18 such that each the first and second edges 58 and 60 generally lie in separate planes that are each generally transverse to the longitudinal axis 50. The first and second edges 58 and 60 of the layer 26 then follow a generally spiral or generally helical path from the proximal edge 54 to the distal edge 56.

When a ball strikes the assembled bat 10 during use, much of the impact forces are transmitted longitudinally along the bat to the handle. The longitudinal portion of the bat transmitting the impact loads is commonly referred to as the line of action. It is not uncommon for bats having a composite layer and a longitudinally extending seam to crack, separate, or otherwise fail at a point along the seam. By reconfiguring the first and second edges 58 and 60 and/or the seam 62 or 64 of the layer 26 so that the edge(s) or seam intersects but does not lie upon, or extend parallel with, the line of action, the present embodiment significantly reduces the likelihood of failure or degradation of the layer 26 at the edge or the seam of the layer 26. Further the non-parallel orientation of the seam 62 or 64 relative to the longitudinal axis provides the insert 18 and the bat 10 with more consistent slugging performance. Without a longitudinally extending seam, the insert provides consistent response regardless of where of where the ball contacts the periphery of the impact portion of the bat.

Figure 19:
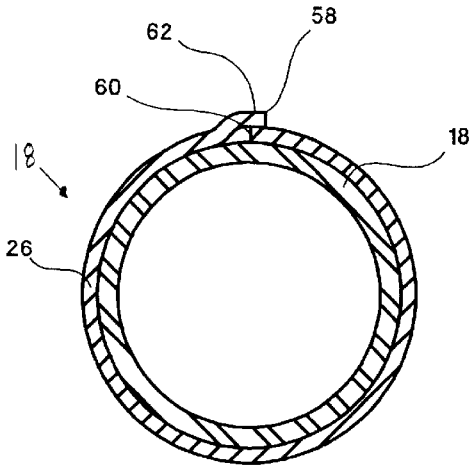
FIG. 19 is a cross-sectional view of the insert taken along line 19—19 of FIG. 18.

Referring to FIGS. 18 and 19, in a preferred embodiment, the layer 26 wraps about, and substantially covers, the periphery of the insert 18 such that the first edge 58 extends over and partially overlaps the second edge 60 to form an overlapped seam 62. Because it is formed by the first and second edges 58 and 60, the overlapped seam 62 substantially follows the same path (non-parallel to the longitudinal axis 50) as the first and second edges 58 and 60. In a particularly preferred embodiment, the first edge 58 overlaps the second edge 60 by between approximately 0.125 inches and 0.375 inches. In another preferred embodiment, the first edge 58 can overlap the second edge 60 by a greater amount such that the first edge 58 is angularly spaced apart from the second edge 60 without necessarily forming a seam.

Figure 20:
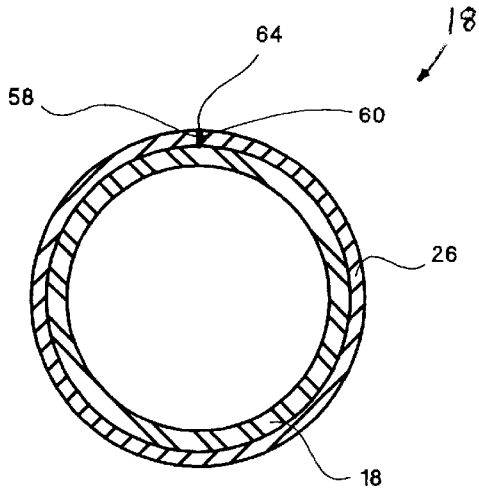
FIG. 20 is a cross-sectional view of an insert in accordance with another preferred embodiment of the present invention.

Referring to FIG. 20, in another preferred embodiment, the layer 26 wraps about, and substantially covers, the periphery of the insert 18 such that the first edge 58 is positioned adjacent to the second 60 to form a non-overlapping seam 64. Because the non-overlapped seam 64 is formed by the first and second edges 58 and 60, the non-overlapped seam 64 follows substantially the same path (non-parallel to the longitudinal axis 50) as the first and second edges 58 and 60. In a particularly preferred embodiment, the first and second edges 58 and 60 contact, but do not overlap, each other. In another particularly preferred embodiment, the first and second edges 58 and 60 are slightly spaced apart from one another.

Figure 21:
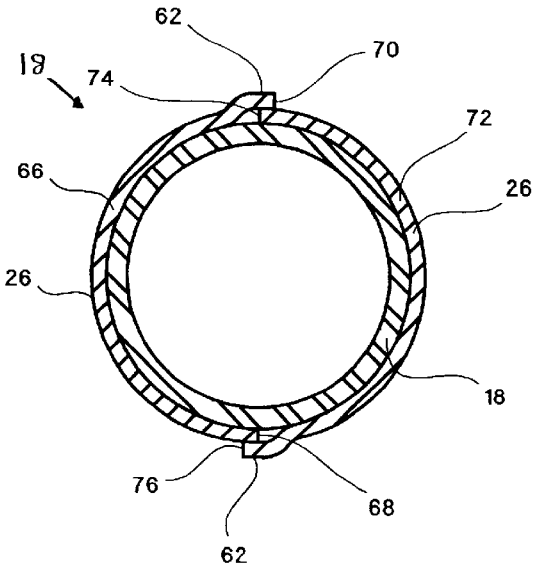
FIG. 21 is a cross-sectional view of an insert in accordance with another preferred embodiment of the present invention.
Figure 22:
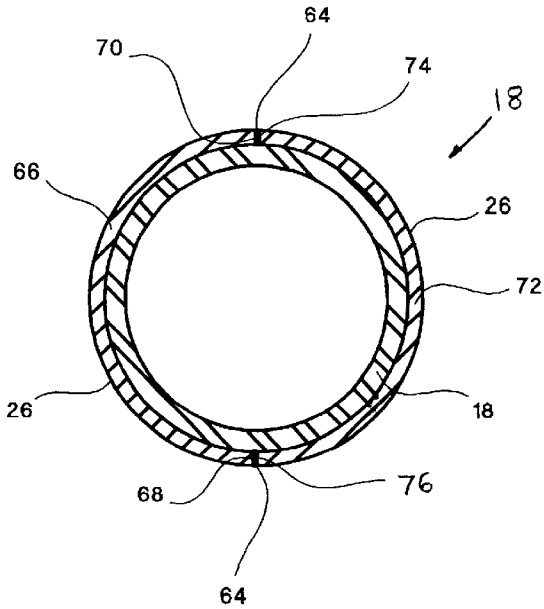
FIG. 22 is a cross-sectional view of an insert in accordance with another preferred embodiment of the present invention.

Referring to FIGS. 21 and 22, each composite layer 26 can be sized to extend over a portion of the periphery of the insert 18, such that two or more layers 26 are required to substantially cover the periphery of the insert 18. Referring to FIG. 21, in a particularly preferred embodiment, a first layer 66 having first and second edges 68 and 70 and a second layer 72 having first and second edges 74 and 76 are wrapped around the periphery of the insert 18. The second edge 70 of the first layer 66 overlaps the first edge 74 of the second layer 72, and the second edge 76 of the second sheet 72 overlaps the first edge 68 of the first layer 66. Each pair of overlapped edges 70 and 74, and 76 and 68 forms an overlapped seam 62. Referring to FIG. 22, in another particularly preferred embodiment, the first and second layers 66 and 72 wrap about, and substantially cover the periphery of the insert 18, such that the second edge 70 of the first layer 66 is positioned adjacent the first edge 74 of the second layer 72, and the second edge 76 of the second sheet 72 is positioned adjacent to the first edge 68 of the first layer 66. Each pair of adjacent edges 70 and 74, and 76 and 68 form a non-overlapped seam 64. In alternative preferred embodiments, three or more layers 26 can be applied to the insert 18 to substantially cover the periphery of the insert 18.

Figure 23:
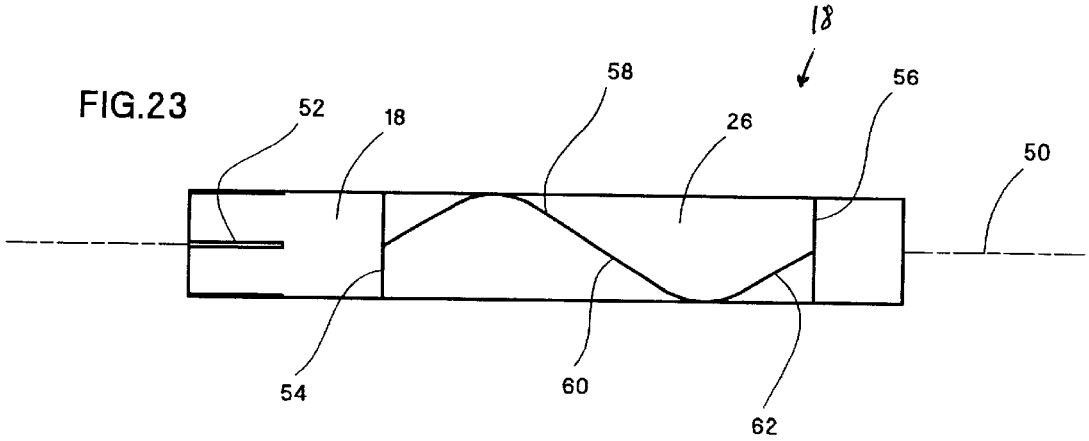
FIG. 23 is a side perspective view of an insert in accordance with another preferred embodiment of the present invention.
Figure 24:
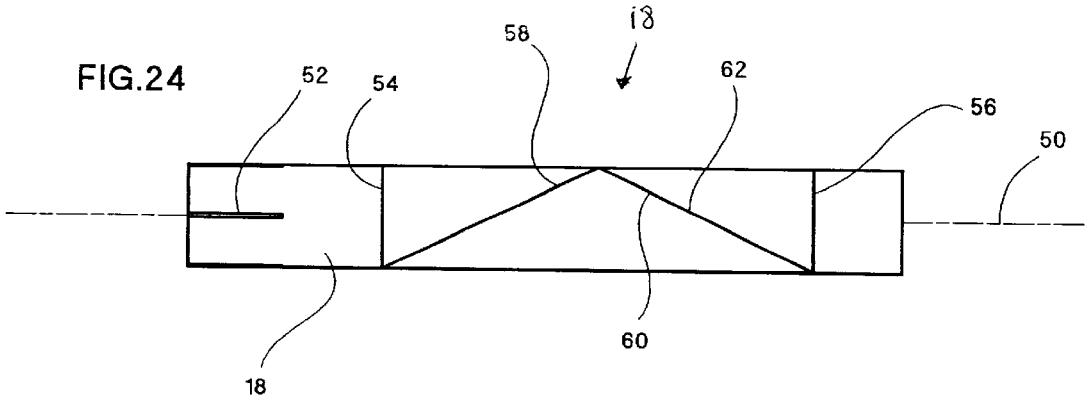
FIG. 24 is a side perspective view of an insert in accordance with another preferred embodiment of the present invention.

In other alternative preferred embodiments, the layer 26, whether single or multiple, can be formed in other shapes, such that one or both of the first and second edges 58 and 60 each follow a non-spiral path that is substantially non-parallel to the longitudinal axis 50. Referring to FIG. 23, in one preferred embodiment, the first and second edges 58 and 60 can form a curved path, such as a substantially sinusoidal path. Referring to FIG. 24, in another preferred embodiment, the first and second edges 58 and 60 can form an angled or jagged path. In alternative preferred embodiments, the first and second edges 58 and 60 can form other paths which are also substantially non-parallel to the longitudinal axis 50, such as, for example, a serrated path, a convoluted path, an irregular path, and combinations thereof.

Figure 25:
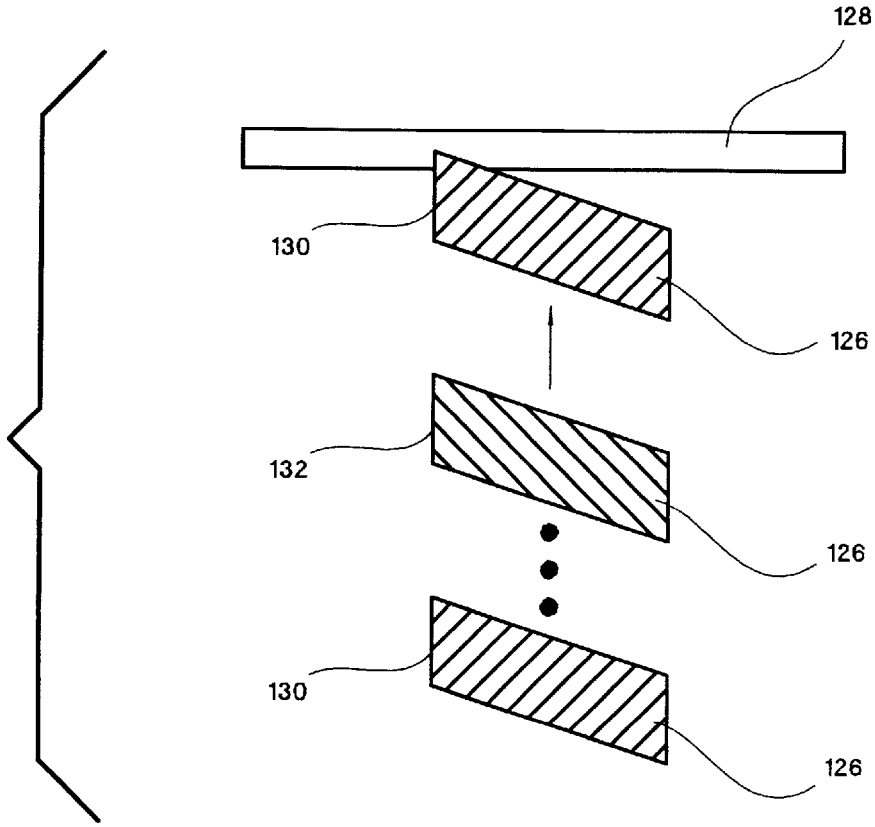
FIG. 25 is a side view of a mandrel and a plurality of composite layers in accordance with a preferred method of the present invention.
Figure 26:
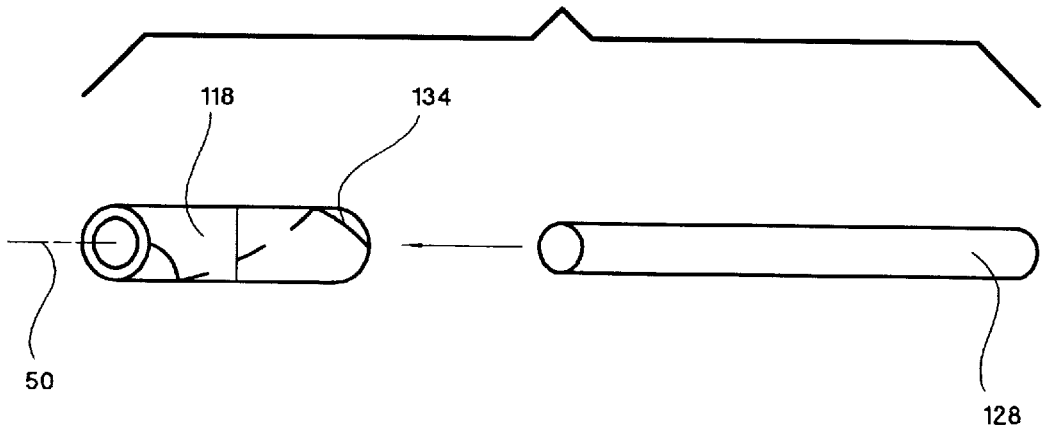
FIG. 26 is a side perspective view of the mandrel and a composite insert in accordance with a preferred method of the present invention.
Figure 27:
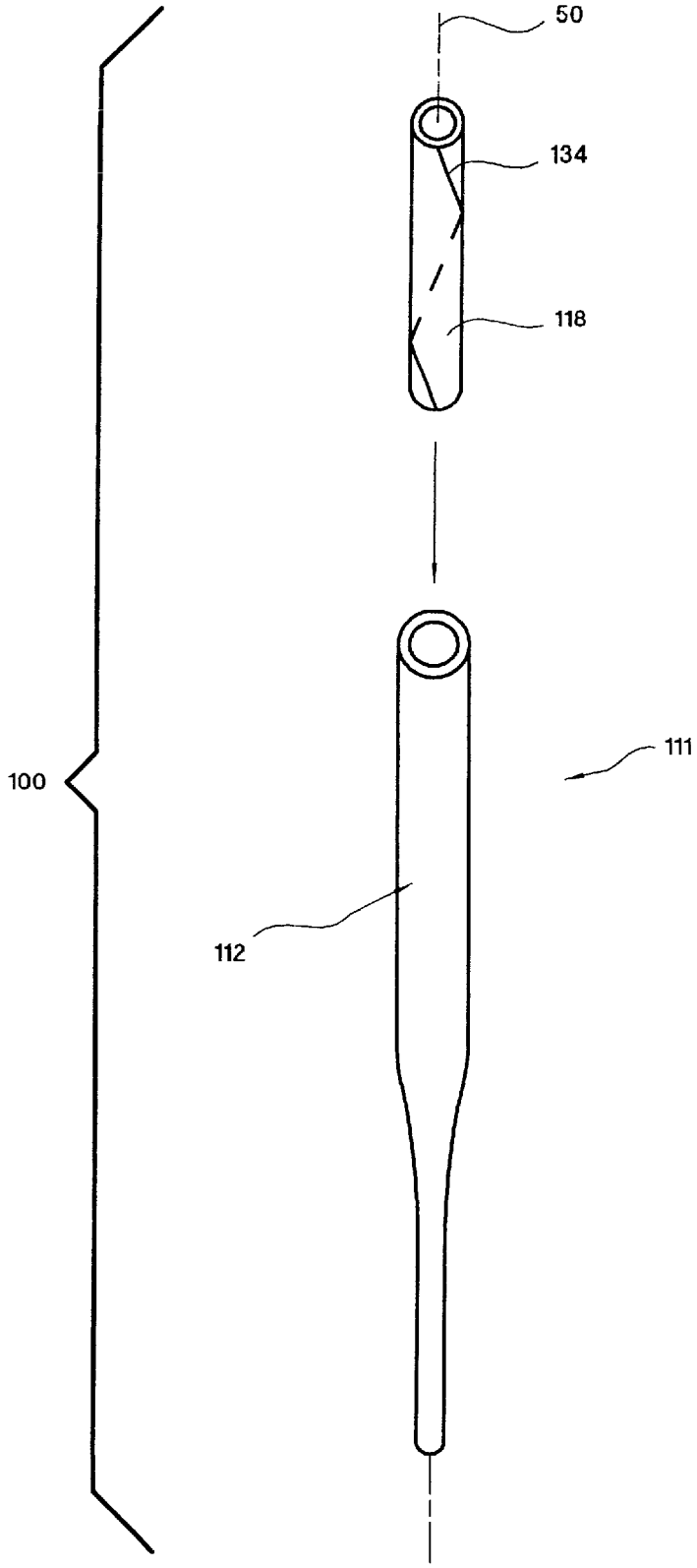
FIG. 27 is a side perspective view of a composite insert and a bat frame in accordance with a preferred method of the present invention.

Referring to FIGS. 25–27, a composite insert 118 for a bat 110 is formed of a plurality of composite layers 126. The composite insert 118 is preferably sized to generally match the size of the insert 18. Referring to FIG. 25, in a preferred method, the composite insert 118 is initially formed by sequentially wrapping the plurality of layers 126 about a mandrel 128. The bat frame 111 and the layers 126 are substantially equal to the bat frame 11 and the layer 26 of the previous embodiments. The layers 126 preferably include a series of fibers that are supported within a matrix material. The fibers can extend in any direction. In one preferred embodiment, the fibers extend at approximately 90 degrees from the longitudinal axis 50. This orientation substantially increases the strength of the layer 126, and the insert 118, in the substantially circumferential direction. In another preferred embodiment, the fibers lie between 65 and 85 degrees and/or between 95 and 125 degrees from the longitudinal axis 50. In a particularly preferred embodiment, the plurality of layers 126 comprising the insert 118 include at least first and second groups of layers 130 and 132. The first group 130 includes layers orientated at approximately 78 degrees and the second group 132 includes layers orientated at approximately 112 degrees.

Each of the panels 126 is cut into a shape that when wrapped about the mandrel 128 results in a seam 134 extending from one end of the panel 126 to the other along a path that is substantially non-parallel to the longitudinal axis 50. The seam 134 can be overlapped or non-overlapped. In a particularly preferred embodiment, each of the panels 126 is formed in the shape of a parallelogram. In alternative preferred embodiments, the panels 126 can be formed into other shapes, such as, for example, other polygonal shapes, irregular shapes, curved shapes or combinations thereof.

The first and second groups of layers 130 and 132 can be applied onto the mandrel 128 and/or other layers 130 or 132, in any order or combination. In one preferred embodiment, the first group of layers 130 is applied to the mandrel 118 followed by the second group of layers 132. In another preferred embodiment, the first and second layers 130 and 132 are individually applied to the mandrel in alternating order.

In a preferred method, a first layer 126 is wrapped around and substantially covers the mandrel 128 to form a first seam. Then, a second layer 126 is wrapped about the mandrel 128 and over the first layer 126 to substantially cover the first layer 126, and forms a second seam. The second layer 126 and each subsequent layers are preferably applied to the mandrel 128, and/or previously applied layer (s) 126 in separate angular positions such that the seam formed by each layer is angularly spaced from the seam(s)

of the other layer or layers 126. Additional layers 126 are applied to the mandrel 118 until the desired number of layers 126, or the desired insert thickness, is achieved. Each seam follows a path that is substantially non-parallel with the longitudinal axis 50 of the insert 118 and the seams are staggered or angularly spaced from each other such that two or more seams are not stacked onto each other. This seam configuration increases the ability of the insert 118 to withstand impact loads, particularly along the line of action of the bat 100 and the insert 118. The insert 118 can include two or more layers 126 and preferably has a thickness of between 0.050 and 0.125 inches. Each layer comprising the insert 118 preferably has a thickness of between 0.003 and 0.0015 inches.

Referring to FIG. 26, when the desired number of layers 126 or the desired thickness is obtained, the insert 118 can be removed from mandrel 128. In a preferred embodiment, the insert 118 is wrapped under tension in a shrinkable material, such as a shrink-wrap plastic material, and heated to cure. Once cured, the insert 118 is removed from the mandrel 128. Then, while in a final hardened condition, the shrinkable material is removed from the insert 118. In another preferred embodiment, the insert 118 is removed with the layer(s) 126 in a tacky, uncured condition.

Referring to FIG. 27, the insert 118 is then inserted into an impact portion 112 of the bat frame 111. The insert 118 engages the impact portion 112 such that a gap, similar to the gap 34, exists at at least some point between the impact portion 112 and the insert 118. The gap enables the insert 118 to move independently of the bat frame 111 during use. The independent movement enables the insert 118 and the frame 111 to function during use with the characteristics of a leaf spring. The gap can be annular, partially annular or consist of one or more spaces between points of contact between the insert 118 and the impact portion 112. A mold release can be applied to the inner surface of the impact portion 112 and/or to the outer peripheral surface of the insert to facilitate independent movement of the insert 118 and the impact portion 112 during use. In another alternative preferred embodiment, a lubricant can be disposed between the impact portion 112 and the insert 118.

Figure 28:
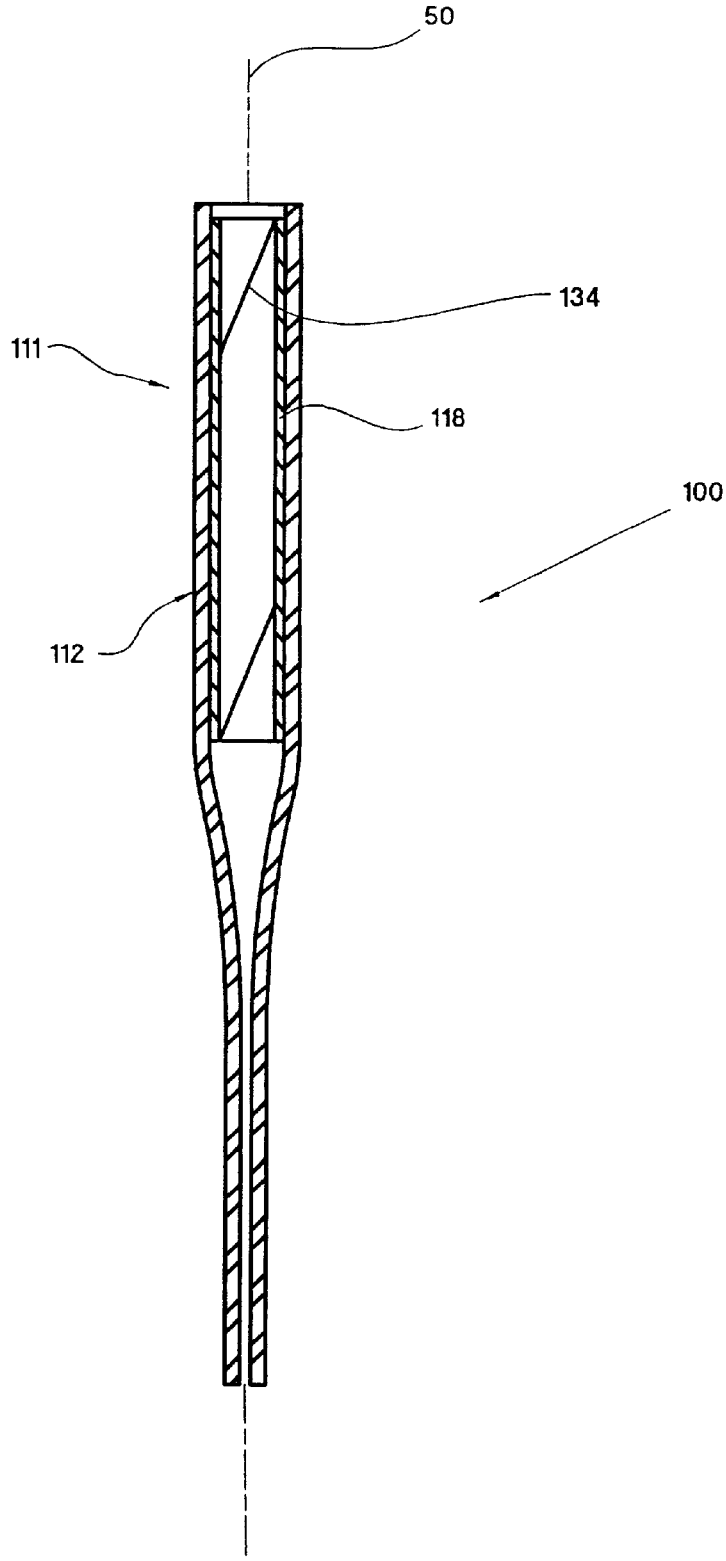
FIG. 28 is a longitudinal cross-sectional view of the composite insert and the bat of FIG. 27.

Referring to FIGS. 27 and 28, the insert 118 can be inserted into the impact portion 112 in a tacky or uncured condition. After insertion, a bladder, such as a latex bladder, can be inserted through the inside diameter of the insert. The bladder is then pressured with a gas, such as, for example, air or nitrogen. The pressurized bladder bears against the inside surface of the insert 118 forcing the insert 118 against the inside surface of the impact portion 112 to mold or cure the insert 118 against the impact portion 112. In a particularly preferred embodiment, the bat frame 111 and the insert 118 are heated, for example, to a temperature of 250 degrees F., for a period of time before and during the pressurization of the bladder. Because the thermal expansion of metallic impact portion 112 is greater than that of the composite insert 118, the impact portion 112 to expands slightly enabling the insert 118 having an outer diameter of generally equal to or slightly greater than the inside diameter of the impact portion 112 under normal ambient conditions to be inserted within the impact portion 112. Upon cooling, the impact portion 112 substantially returns to its original size and the insert 118 substantially retains its size creating a tight fit between the insert 118 and the impact portion 112. Even under this tight fit condition, the gap, which can include the mold release or a lubricant, enables the insert 118 to move independently of the impact portion 112 during use.

Figure 29:
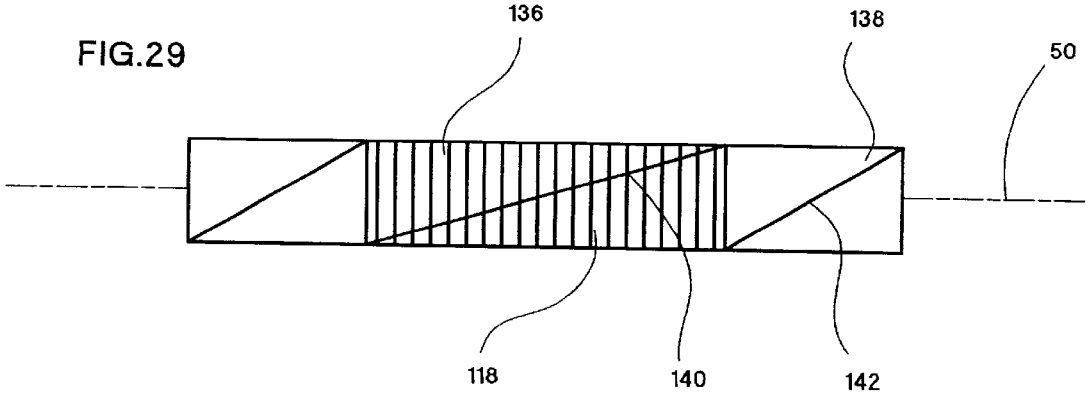
FIG. 29 is a side view of an insert in accordance with another preferred embodiment of the present invention.

Referring to FIG. 29, an alternative preferred embodiment of the insert 118 is illustrated. The insert 118 includes a plurality of layers 136 of a length substantially equal to the length of the insert, and having fibers orientated in a first direction. At least a pair of shorter layers 138 are spaced apart and wrapped about the plurality of layers 136. Preferably, the shorter layers 138 are formed of an elastomeric or cushionable material, such as, for example, a rubber or a foam. The shorter layers 138 form the outer layers of the insert 118, which contact the impact portion 112 of the bat frame 111 during use. The layers 138 serve to dampen vibration caused by impact of the bat 110 with a ball, and thereby improve the feel of the bat during use. In an alternative preferred embodiment, the shorter layers 138 can include fibers oriented in the first direction or in a second direction. In a particularly preferred embodiment, the plurality of layers 136 include eight layers each having a length of approximately 8 inches and including fibers orientated at approximately 90 degrees from the longitudinal axis 50, and the shorter layers 138 preferably are approximately 2.5 inches in length. Each of the layers 136 and 138 are formed of a shape that produces a seam, when wrapped about a mandral or another layer that is substantially non-parallel with the longitudinal axis 50. The non-parallel seam(s) relative to the longitudinal axis 50 of the insert 118 provide the insert 118 with more consistent operational performance and substantially eliminates locations of degraded operational or slugging performance. In alternative preferred embodiments, other numbers and sizes of layers, layer fiber orientations, and layer shapes can be used.

In view of the wide variety of embodiments to which the principles of the invention can be applied, it should be apparent that the detailed embodiments are illustrative only and should not be taken as limiting the scope of the invention. Rather, the claimed invention includes all such modifications as may come within the scope of the following claims and equivalents thereto.

What is claimed is:

1. An insert for a bat having a frame, the insert comprising:

a substantially tubular body extending along a longitudinal axis, the body having internal and external surfaces, the body being formed of a first material; and at least one sheet having a proximal edge, a distal edge, and first and second side edges, the at least one sheet coupled to at least a portion of one of the internal and external surfaces of the body such that the first and second edges each extend from the proximal edge to the distal edge alone a path that is substantially non-parallel with the longitudinal axis, the at least one sheet being formed of a second material which is different from the first material, the insert configured to be capable of moving independently with respect to the frame during use, the body having a periphery, the first edge contacting the body, and the sheet wrapping about periphery of the body such that at least a portion of the sheet overlaps itself.

2. An insert for a bat having a frame, the insert comprising:

a substantially tubular body extending along a longitudinal axis, the body having internal and external surfaces, the body being formed of a first material and at least one sheet having a proximal edge, a distal edge, and first and second side edges, the at least one sheet coupled to at least a portion of one of the internal and external surfaces of the body such that the first and second edges each extend from the proximal edge to the distal edge along a path that is substantially non-parallel with the longitudinal axis, the at least one sheet being formed of a second material which is different from the first material, the insert configured to be capable of moving independently with respect to the frame during use, the sheet having greater strength in a peripheral direction than in a longitudinal direction.

3. An insert for a bat comprising:

a substantially tubular body extending along a longitudinal axis, the body having internal and external surfaces, the body including a proximal portion and a distal portion, at least one longitudinally extending slit being formed in the proximal portion of the body; and at least one sheet having a proximal edge, a distal edge, and first and second side edges, the at least one sheet coupled to at least a portion of one of the internal and external surfaces of the body such that the first and second edges each extend from the proximal edge to the distal edge along a path that is substantially non-parallel with the longitudinal axis.

4. The insert of claim 3 wherein the first edge overlaps the second edge along at least a portion of the path to form an overlapped seam.

5. The insert of claim 3, wherein the path taken by at least one of the first and second side edges between the proximal edge and the distal edge is selected from the group consisting of helical, sinusoidal, convoluted, jagged, curved, irregular and combinations thereof.

6. The insert of claim 3 wherein the sheet comprises a material selected from the group consisting of a fiber matrix composite, a metal matrix composite, a carbon matrix composite, a rubber, a urethane, an elastomer and combinations thereof.

7. The insert of claim 3 wherein the body has a periphery, wherein the first edge contacts the body, and wherein the sheet wraps about periphery of the body such that at least a portion of the sheet overlaps itself.

8. The insert of claim 3 wherein the sheet has greater strength in a peripheral direction than in a longitudinal direction.

9. A ball bat comprising:

a substantially tubular frame extending along a longitudinal axis having a handle portion and a primary hitting portion;

a substantially tubular and generally seamless body coaxially aligned with the hitting portion of the frame, the body being capable of moving independently with respect to the frame during use; and at least one sheet having a proximal edge, a distal edge, and first and second side edges, the sheet coupled to at least a portion of one of the hitting portion of the frame and the body such that the first and second edges each extend from the proximal edge to the distal edge along a path that is substantially non-parallel with the longitudinal axis, the sheet being comprised of a material selected from the group consisting of a composite fiber matrix, a rubber, a urethane, an elastomer and combinations thereof.

10. The ball bat of claim 9 wherein the first edge overlaps the second edge along at least a portion of the path to form an overlapped seam.

11. The ball bat of claim 9 wherein the first edge is positioned adjacent to the second edge along at least a portion of the path to form a non-overlapped seam.

12. The ball bat of claim 9 wherein the hitting portion includes an inner surface and an outer surface, and wherein the at least one sheet is coupled to the inner surface of the hitting portion.

13. The ball bat of claim 9 wherein the hitting portion includes an inner surface and an outer surface, and wherein the at least one sheet is coupled to the outer surface of the hitting portion.

14. The ball bat of claim 9 wherein the at least one sheet includes first and second sheets with the second edge of the first sheet overlapping the first edge of the second sheet and the second edge of the second sheet overlapping the first edge of the first sheet.

15. The ball bat of claim 9, wherein the path taken by at least one of the first and second side edges between the proximal edge and the distal edge is selected from the group consisting of helical, sinusoidal, convoluted, jagged, curved, irregular and combinations thereof.

16. The ball bat of claim 9 wherein the hitting portion has an inner surface, wherein the first edge contacts the inner surface of the hitting portion, and wherein the sheet covers at least of a portion of the inner surface such that at least a portion of the sheet overlaps itself.

17. A ball bat comprising:

a substantially tubular frame extending along a longitudinal axis having a handle portion and a primary hitting portion;

a substantially tubular body coaxially aligned with the hitting portion of the frame, the body including a proximal portion and a distal portion, at least one longitudinally extending slit being formed in the proximal portion of the body; and at least one sheet having a proximal edge, a distal edge, and first and second side edges, the sheet coupled to at least a portion of one of the hitting portion of the frame and the body such that the first and second edges each extend from the proximal edge to the distal edge along a path that is substantially non-parallel with the longitudinal axis.

18. The ball bat of claim 17 wherein the first edge overlaps the second edge along at least a portion of the path to form an overlapped seam.

19. The ball bat of claim 17 wherein the hitting portion includes an inner surface and an outer surface, and wherein the at least one sheet is coupled to the outer surface of the hitting portion.

20. The ball bat of claim 17 wherein the path taken by at least one of the first and second side edges between the proximal edge and the distal edge is selected from the group consisting of helical, sinusoidal, convoluted, jagged, curved, irregular and combinations thereof.

21. The ball bat of claim 17 the sheet comprises a material selected from the group consisting of a fiber matrix, a rubber, a urethane, an elastomer and combinations thereof.

* * * * *